US009439495B2

(12) United States Patent
Yoo

(10) Patent No.: US 9,439,495 B2
(45) Date of Patent: Sep. 13, 2016

(54) COMPACT HAVING PROTRUSIBLE AND RETRACTABLE VIBRATING PUFF

(71) Applicant: Koon Il Yoo, Seoul (KR)

(72) Inventor: Koon Il Yoo, Seoul (KR)

(73) Assignee: HANKOOK P&P CO., LTD., Wonyang-Ro, Wonsam-Myeon, Cheoin-Gu, Yongin-Si, Kyunggi-Do (KR)

( * ) Notice: Subject to any disclaimer, the term of this patent is extended or adjusted under 35 U.S.C. 154(b) by 0 days.

(21) Appl. No.: 14/365,547

(22) PCT Filed: Dec. 3, 2012

(86) PCT No.: PCT/KR2012/010396
§ 371 (c)(1),
(2) Date: Jun. 13, 2014

(87) PCT Pub. No.: WO2014/081061
PCT Pub. Date: May 30, 2014

(65) Prior Publication Data

US 2015/0250287 A1 Sep. 10, 2015

(51) Int. Cl.
*A45D 33/02* (2006.01)
*A45D 33/00* (2006.01)
(Continued)

(52) U.S. Cl.
CPC ..... *A45D 33/006* (2013.01); *A45D 33/04* (2013.01); *A45D 33/34* (2013.01)

(58) Field of Classification Search
CPC .. A45D 40/26; A45D 40/262; A45D 40/264; A45D 40/265; A45D 40/0075; A45D 2200/1009; A45D 2200/1018; A45D 2200/207; A45D 33/34; A45D 33/36; A45D 33/003; A45D 33/006; A45D 33/04; A45D 33/16; A46B 13/023
USPC ..... 132/299, 320, 119.1, 313, 317, 318, 132/293, 297, 298, 303, 305; 601/17, 18, 601/46, 89, 97, DIG. 15; 15/229.14; 401/130, 261, 266, 200; 331/113 R, 331/143, 187
See application file for complete search history.

(56) References Cited

U.S. PATENT DOCUMENTS 1,362,808 A * 12/1920 McFarland ..... A45D 40/265 132/299
3,128,923 A * 4/1964 Gabler ..... A45D 40/0075 222/183

(Continued)

FOREIGN PATENT DOCUMENTS

KR 10-2004-0106930 A 12/2004
KR 10-2005-0027322 A 3/2005

(Continued)

*Primary Examiner* — Rachel Steitz
(74) *Attorney, Agent, or Firm* — John K. Park; Park Law Firm

(57) ABSTRACT

A compact having a protrusible and retractable puff includes a lower case having a spring seated therein, an upper case having a seating section and a guide section which extend downward through a central portion, a puff assembly fitted into the seating section, the puff assembly having a puff member fixed to a lower portion, a lift fitted into the guide section, and an inner dish positioned on top of the lift. The puff assembly has a switch and a battery. The puff member is coupled to a separate elastic moving body coupled to the puff assembly. A vibrator is accommodated inside the elastic moving body. The puff assembly is coupled to and separated from the upper case, protrudes upward from the upper case under repulsive force of the spring, such that the puff member vibrates when the vibrator is operated by the switch.

8 Claims, 8 Drawing Sheets

(51) Int. Cl.
*A45D 33/04* (2006.01)
*A45D 33/34* (2006.01)

(56) References Cited

U.S. PATENT DOCUMENTS 7,011,098 B2 * 3/2006 Byun ..... A45D 40/265 132/293
7,306,569 B2 * 12/2007 LaJoie ..... A45D 33/005 601/17
7,726,322 B2 * 6/2010 Cho ..... A45D 33/04 132/294
7,917,983 B2 * 4/2011 Taggart ..... A45D 24/16 132/119.1
8,286,647 B2 * 10/2012 Bae ..... A45D 33/006 132/305
8,430,587 B2 * 4/2013 De Laforcade ..... A45D 33/00 401/121
8,505,556 B2 * 8/2013 Park ..... A45D 33/006 132/320
2008/0011320 A1 * 1/2008 Bouix ..... A45D 33/006 132/293
2008/0193493 A1 * 8/2008 Rhoades ..... A45D 34/041 424/401
2013/0333718 A1 * 12/2013 Kim ..... A45D 33/36 132/293

FOREIGN PATENT DOCUMENTS

KR 20-0382428 Y1 4/2005
KR WO 2009123380 A1 * 10/2009 ..... A45D 33/006

* cited by examiner

COMPACT HAVING PROTRUSIBLE AND RETRACTABLE VIBRATING PUFF

BACKGROUND OF THE INVENTION

1. Field of the Invention

The present invention relates to a compact having an inner dish which contains a cosmetic powder, and more particularly, to a compact having a separate puff assembly which protrudes from the upper portion of the compact and retracts into and is fixed to the upper portion of the compact in response to rotation, and which has a vibrator which operates using power supplied from a battery disposed inside the puff assembly and is accommodated in an elastic movable body which connects a puff member to the puff assembly, such that a user can more conveniently apply makeup using the vibrating puff member, and such that the compact can have a simple, consumer-satisfying outer appearance.

2. Description of the Related Art

In general, a cosmetics case referred to as a "compact" has a small profile and good portability such that it can easily carry various types of cosmetic powders for use.

The compact includes a case body which is divided into upper and lower sections and a cover. One portion of the cover is fixed to one portion of the body via a hinge, and a locking means is provided on the other sides of the body and the cover. An inner dish is accommodated inside the body, and an inner cover and a puff are disposed on top of the inner dish such that the inner cover and the puff can be separated from the inner dish.

When the compact is to be used for various types of makeup, the cover is raised from the body to open the inside of the body, the puff is held with a hand, and then the inner cover is separated. Afterwards, a cosmetic powder is transferred to the puff and then is applied to an intended region.

In this compact, the puff which is disposed inside the compact can be positioned on top of or under the inner dish. When the puff is positioned under the inner dish, a user can apply makeup by temporarily raising the inner dish, taking out the puff, seating the inner dish in the body again, and then applying the puff to the intended region.

However, these compacts have been fabricated in the shape of vessels having the same structure ever since the development thereof, and fail to satisfy a variety of preferences of consumers who purchase these products. The hinge coupling part or the mutual locking means is modified or an inner component was varied or added for the purpose of diversity. However, these approaches are intended to satisfy the desires of consumers by simply imparting a restrictive modification or addition to the same basic structure of the vessel. Therefore, these approaches failed to attract active interest of consumers, and consumers were easily tired of these approaches, which are problematic.

In addition, the conventional compact has a problem in that a hinge pin is dislodged due to frequent use of the hinge coupling part which connects the body and the cover. The mutual locking means between the body and the cover is also easily damaged due to frequent use. Therefore, in some cases, the compact case becomes useless before the content is exhausted.

Furthermore, the hinge coupling part and the mutual locking means protrude from the case in most cases. When the hinge coupling part or the mutual locking means touches clothes, a bag or articles stored inside the bag, it may damage the clothes, bag or articles.

In particular, the puff positioned inside the compact is configured such that a user uses the puff by holding it with fingers or inserting fingers into a band provided on the upper portion of the puff. The puff is relatively small sized due to the characteristics of the compact. So, it is frequent that the cosmetic powder is accidently transferred to the fingers of the user while the user is applying makeup using the puff. In some cases, the unused portion of the puff may also be fouled by the cosmetic powder attached to the fingers; the puff may stay fouled by the cosmetic powder. This causes the user to be reluctant to use the puff and renders the appearance of the puff unattractive.

In addition, since the compact requires the user to apply makeup while manually tapping the puff to the skin, applying makeup is inconvenient. A person who does not frequently apply makeup or is unaccustomed to applying makeup does not tap the puff with a uniform force, and thus the applied cosmetic powder may clump. Since the tapping speed is also limited, it is impossible to rapidly apply makeup. Since neither the tapping force nor the tapping speed is uniform, the cosmetic powder is neither uniformly applied nor does it tightly adhere to the skin to which it is applied.

The information disclosed in the Background of the Invention section is only for the enhancement of understanding of the background of the invention, and should not be taken as an acknowledgment or any form of suggestion that this information forms a prior art that would already be known to a person skilled in the art.

SUMMARY OF THE INVENTION

Accordingly, the present invention has been made keeping in mind the above problems occurring in the related art, and the present invention is intended to propose a compact having a protrusible and retractable puff in which a puff assembly can be easily coupled to and separated from an upper case due to rotation. The puff assembly interferes with a spring positioned inside a lower case and an inner dish which is moved upwards under repulsive force of the spring. A vibrating means is provided inside the puff assembly, and causes power from a battery to be induced to a vibrator using a switch. The vibrator is positioned inside an elastic movable body to which a puff member is coupled. A cosmetic powder in the inner dish is naturally transferred to a puff member during the rotation of the puff assembly, and since the puff assembly protrudes from the upper case due to the rotation, a user can easily hold and use the puff assembly. Vibrating force is transferred to the puff member so that the user can more rapidly and easily apply makeup and the cosmetic powder is uniformly applied and adheres tightly to the skin. The puff assembly is rotated by being pressed downwards so that it can be firmly coupled and fixed to the upper case.

In order to achieve the above object, according to one aspect of the present invention, there is provided a compact having a protrusible and retractable puff that includes: a lower case having a spring seated therein; an upper case having a seating section and a guide section which extend downward through a central portion; a puff assembly fitted into the seating section, the puff assembly having a puff member fixed to a lower portion; a lift fitted into the guide section; and an inner dish positioned on top of the lift. The puff assembly has a switch and a battery which are disposed therein, the puff member is coupled to a separate elastic moving body which is coupled to the puff assembly, a vibrator is accommodated inside the elastic moving body, the vibrator operating using power supplied from the battery.

The puff assembly is to be coupled to and separated from the upper case, protrudes upward from the upper case under repulsive force of the spring, and is configured such that the puff member vibrates when the vibrator is operated by the switch and using the power from the battery.

According to the present invention as set forth above, the cosmetic powder is naturally transferred to the puff member during the process of rotating the puff assembly to separate it from the case, and thus a corresponding action for transferring the cosmetic powder to the puff member is not required. Since the puff assembly protrudes from the case as soon as the puff assembly is rotated, a user can easily use the puff assembly by holding it and thus can more conveniently apply makeup. Since vibrating force is transferred to the puff member, the user can more rapidly and easily apply makeup, and the cosmetic powder is uniformly applied and tightly adheres to the skin.

Since the user holds the puff assembly instead of the puff, fingers of the user or the like are prevented from being fouled by the cosmetic powder. In addition, after the application of the makeup is finished, the puff assembly is firmly fixed to the case through the operation of rotating the puff assembly with respect to the case while pressing it against the case. Accordingly, neither the hinge coupling part nor the locking means of the related art is required. It is therefore possible to produce a simple and attractive appearance while overcoming all of the problems involving the hinge coupling part and the locking means.

BRIEF DESCRIPTION OF THE DRAWINGS

The above and other objects, features and advantages of the present invention will be more clearly understood from the following detailed description when taken in conjunction with the accompanying drawings, in which.

DETAILED DESCRIPTION OF THE INVENTION

Figure 1:
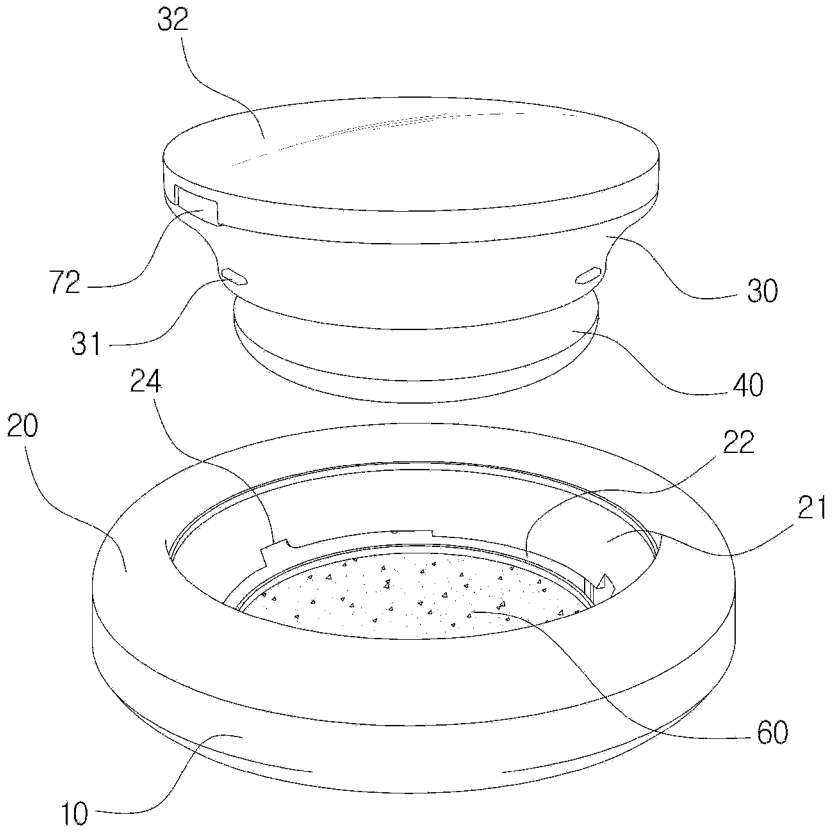
FIG. 1 is an overall perspective view showing a compact according to an exemplary embodiment of the present invention.

The terms or words used in the description and claims of the present invention should not be interpreted as being limited merely to common and dictionary means. On the contrary, they should be interpreted based on the meanings and concepts in compliance with the scope of the present invention on the basis of the principle that the inventor(s) can appropriately define the terms in order to describe the invention in the best way.

Reference will now be made in greater detail to exemplary embodiments of the present invention, an example of which is illustrated in the accompanying drawings. Wherever possible, the same reference numerals will be used throughout the drawings and the description to refer to the same or like parts.

Figure 2:
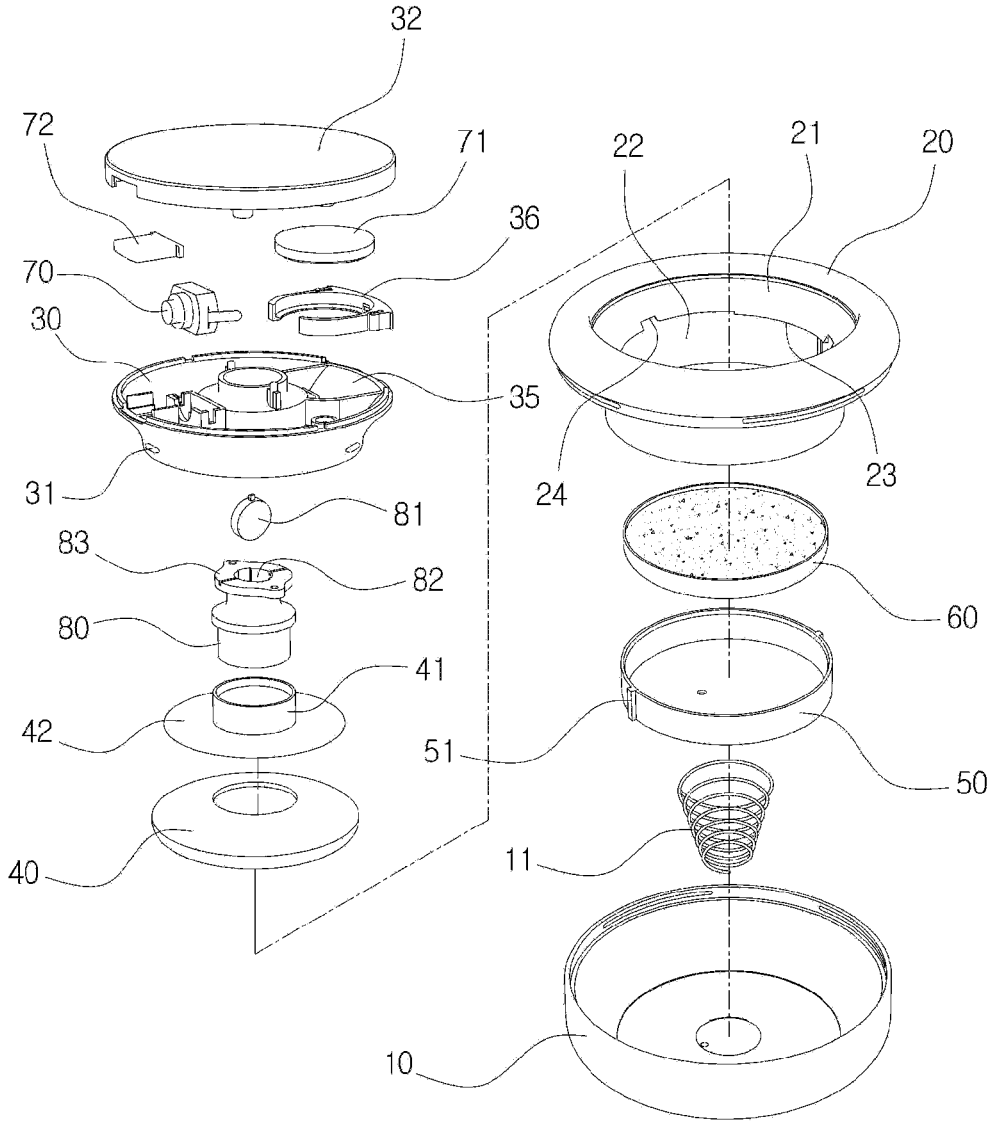
FIG. 2 is a top exploded perspective view showing the compact according to an exemplary embodiment of the present invention.
Figure 3:
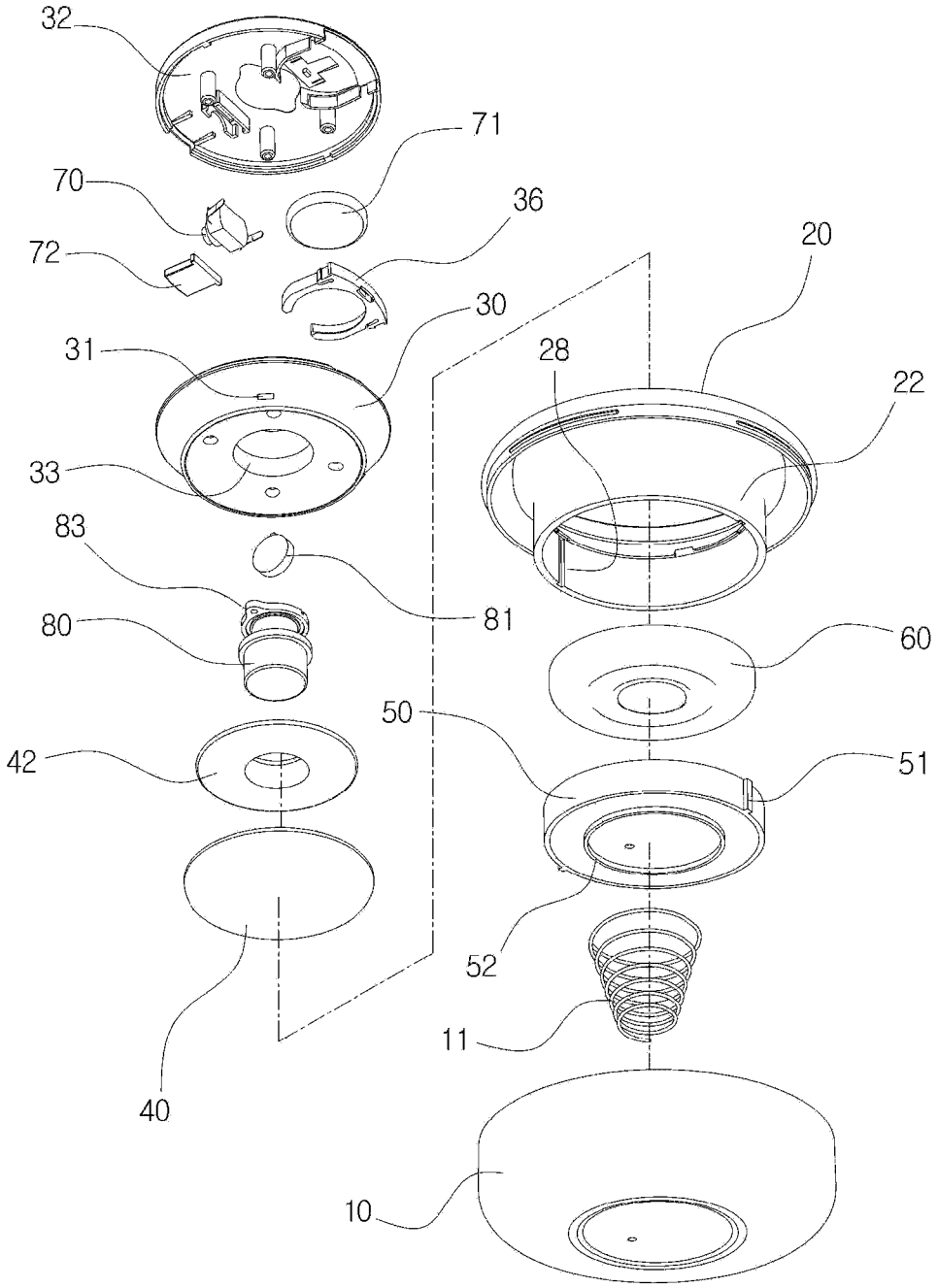
FIG. 3 is a bottom exploded perspective view showing the compact according to an exemplary embodiment of the present invention.
Figure 4:
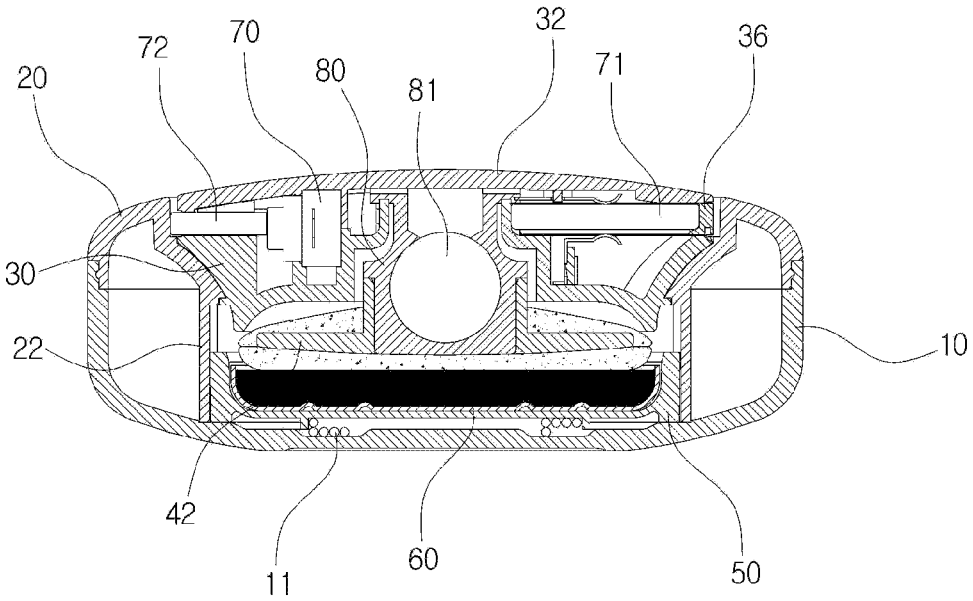
FIG. 4 is an assembled cross-sectional view showing the compact according to an exemplary embodiment of the present invention.
Figure 5:
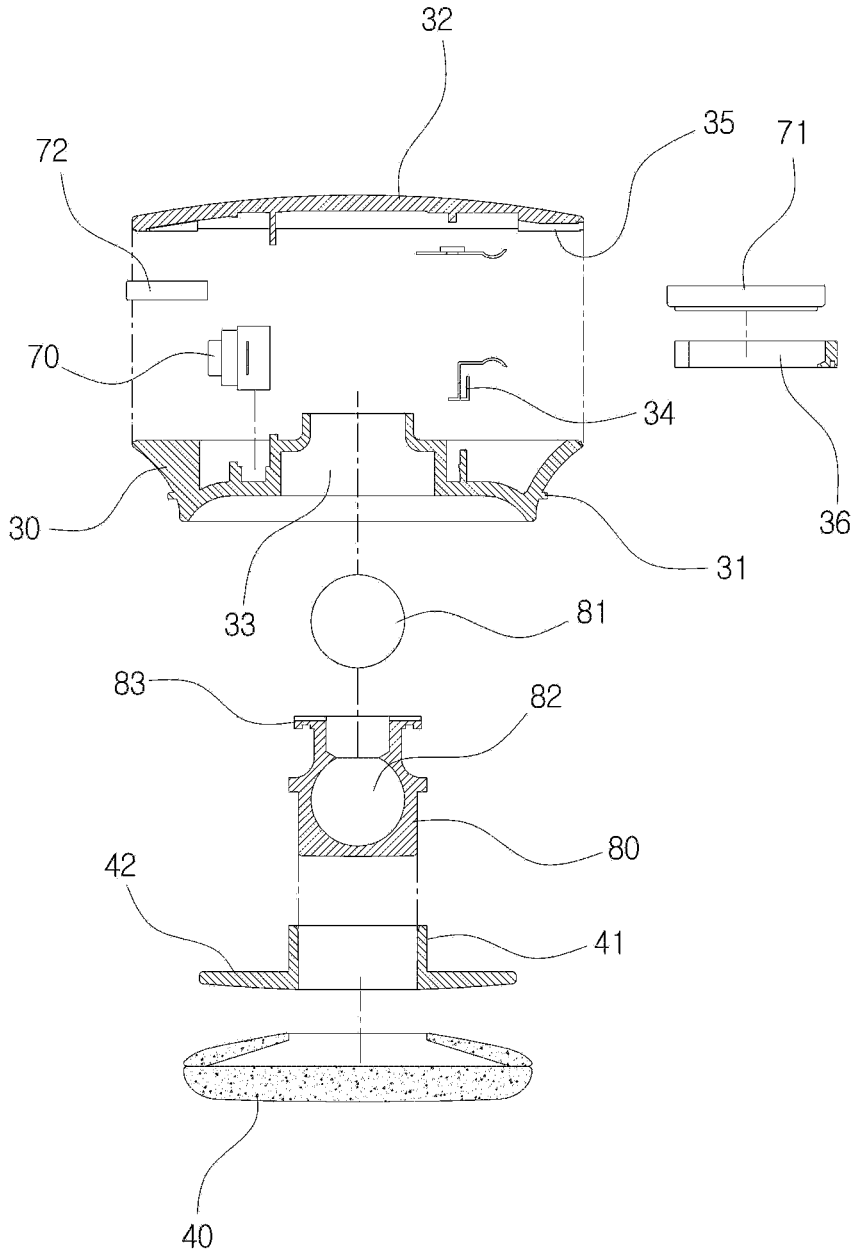
FIG. 5 is an exploded cross-sectional view showing the puff assembly of the compact according to an exemplary embodiment of the present invention.
Figure 6:
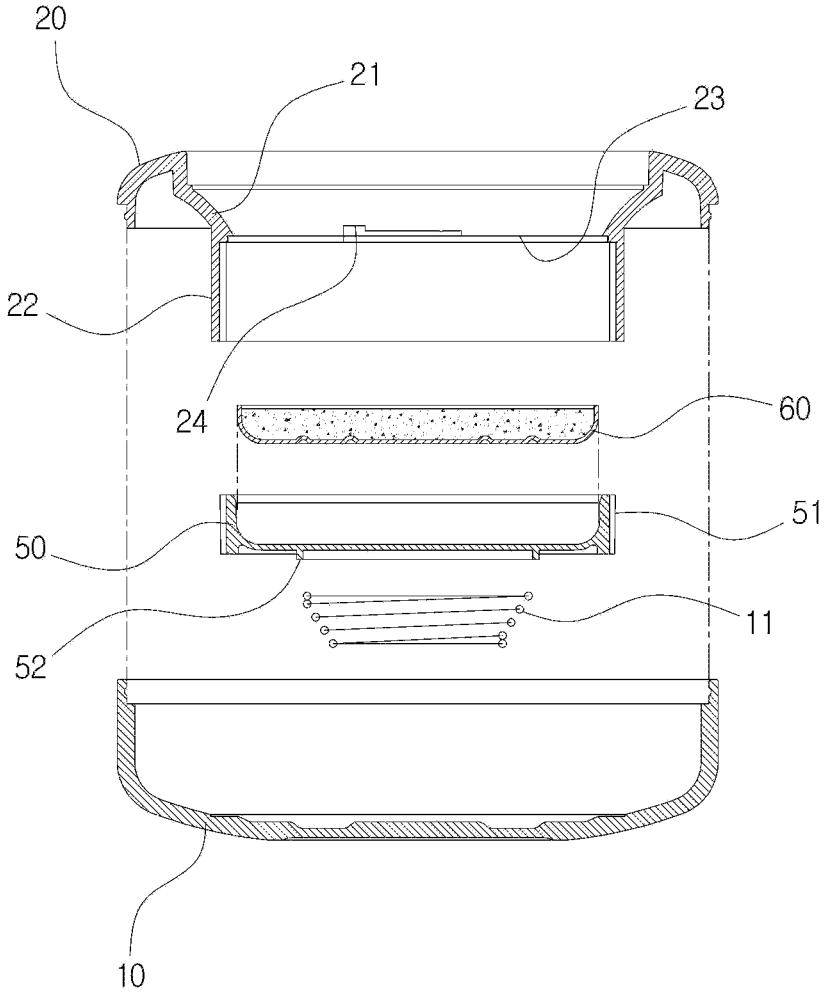
FIG. 6 is an exploded perspective view showing the case of the compact according to an exemplary embodiment of the present invention.

FIG. 1 is an overall perspective view showing a compact according to an exemplary embodiment of the present invention, FIG. 2 is a top exploded perspective view showing the compact according to an exemplary embodiment of the present invention, FIG. 3 is a bottom exploded perspective view showing the compact according to an exemplary embodiment of the present invention, FIG. 4 is an assembled cross-sectional view showing the compact according to an exemplary embodiment of the present invention, FIG. 5 is an exploded cross-sectional view showing the puff assembly of the compact according to an exemplary embodiment of the present invention, and FIG. 6 is an exploded perspective view showing the case of the compact according to an exemplary embodiment of the present invention.

As shown in the figures, the compact according to this exemplary embodiment includes a lower case 10, an upper case 20, a puff assembly 30, a puff member 40, a lift 50 and an inner dish 60.

The upper portion of the lower case 10 is open, and a spring 11 is seated on the inner bottom of the lower case 10.

A seating section 21 extends downward through the central portion of the upper case 20, a tubular guide section 22 extends from the bottom end of the seating section 21 to the inner bottom of the lower case 10. A circular holding rib 23 protrudes inward from the boundary between the seating section 21 and the guide section 22.

In particular, a plurality of fitting holes 24 is formed in the holding rib 23 in the top-bottom direction. An anti-rotation rib 25 extends downward from the holding rib 23 at one side of each fitting hole 24. At the other side of each fitting hole 24, an interference protrusion 26 and a stepped stop 27 are formed on the bottom surface of the holding rib 23 at distances from the fitting hole 24.

In the inner surface of the guide section 22 of the upper case 20 as described above, one or more guide grooves 28 are formed so as to extend in the top-bottom direction.

The puff assembly 30 is accommodated in the seating section 21 of the upper case 20. A plurality of protrusions 31 is formed on the outer surface of the puff assembly 30. A puff member 40 is coupled to the bottom portion of the puff assembly 30.

The puff member 40 is fixed to the puff assembly 30 using a separate coupling member 41. The coupling member 41 has a flange 42 on the lower portion which extends radially outward. As the puff member 40 made of a soft elastic material is fixedly coupled with the coupling member 41 in such a shape that the puff member 40 surrounds the flange 42, the coupling member 41 securely fixes the puff member 40 to the puff assembly 30.

In particular, the puff assembly 30 is coupled with a separate switch 70, a battery 71 and an elastic moving body 80. A vibrator 81 is accommodated in the elastic moving body 80. The puff member 40 is coupled with the elastic moving body 80.

Specifically, a separate cover 32 is coupled to the upper portion of the puff assembly 30. In the state in which the puff assembly 30 is coupled and fixed to the upper case 20, the cover 32 forms a curved or planar surface that is flush or harmonious with the top surface of the upper case 20. Accordingly, the compact in the assembled state can be perceived as an integral part that has a smooth overall appearance.

In addition, the switch 70 is seated and fixed between the puff assembly 30 and the cover 32. The switch 70 is connected to an operation button 72 which is externally positioned on the puff assembly 30. The switch 70 is configured to operate when the operation button 72 is pressed. The battery 71 connected to the switch 70 extends out of the puff assembly 30 through a battery hole 35 formed in the puff assembly 30.

As a battery holder 36 is fitted into the battery hole 35, the battery 71 is naturally inserted into the puff assembly 30 in the state in which it is seated in the battery holder 36. Power terminals 34 are fixed to the top surface of the puff assembly 30 and the bottom surface of the cover at positions corresponding to the position where the battery 71 is accommodated.

Accordingly, the battery 71 can be inserted and replaced as the battery holder 36 is separated from or inserted into the puff assembly 30. The outer surface of the battery holder 36 that is inserted into the puff assembly 30 is identical with the outer surface of the puff assembly 30 such that the battery holder 36 and the puff assembly 30 can be perceived as an integral part. A fingernail recess (no reference numeral in the figures) is formed on the lower portion of the battery holder 36. With the fingernail recess, the battery holder 36 can be easily taken out and separated from the puff assembly 30.

An assembly hole 33 extends in the top-bottom direction through the central portion of the puff assembly 30 such that the elastic moving body 80 can be coupled to the puff assembly 30 through the assembly hole 33. The elastic moving body 80 has a vibrator recess 82 extending inward from the upper portion and a fixing flange 83 formed at a leading end. In the state in which the vibrator 81 is fitted into the vibrator recess 82, the fixing flange 83 is pushed upward through the lower portion of the assembly hole 33 so that the fixing flange 83 is exposed from the top surface of the puff assembly 30. Afterwards, when the cover 32 is firmly fixed to the puff assembly 30, the elastic moving body 80 is pressed so as to be closely adjoined and fixed between the top surface of the puff assembly 30 and the bottom surface of the cover 32. Consequently, the elastic moving body 80 is firmly fixed to the puff assembly 30.

Accordingly, as the coupling member 41 having the puff member 40 is coupled to the bottom end of the elastic moving body 80 which protrudes from the bottom of the puff assembly 30, the puff assembly 30 to which the puff member 40 is coupled can be completed.

The lift 50 is accommodated inside the guide section 22 of the upper case 20 such that the lift 50 moves upwards and downwards in the top-bottom direction along the guide section 22. The lift 50 has insertion protrusions 51 on the outer surface, the insertion protrusions 51 being fitted into the guide grooves 28 of the guide section 22. Accordingly, the lift 50 can move upwards and downwards without rotating with respect to the guide section 22.

In particular, the leading end of the spring 11 which is positioned inside the lower case 10 closely adjoins to the bottom surface of the lift 50. A receiving rib 52 protrudes downward from the bottom surface of the lift 50 such that the leading end of the spring 11 is received therein. The spring 11 positioned below the lift 50 can be compressed and recoil in a reliable manner without moving in a lateral direction.

The separate inner dish 60 is seated on the upper portion of the lift 50. Various types of cosmetic powders are injected into and solidified in the inner dish 60 by automated processes. The bottom surface of the puff member 40 closely adjoins to the top surface of the inner dish 60.

Accordingly, when the spring 11 is seated inside the lower case 10, the lift 50 having the inner dish 60 is accommodated inside the guide section 22 of the upper case 20, and then the lower case 10 and the upper case 20 are firmly fastened to each other, the lift 50 moves upwards along the guide section 22 under the repulsive force of the spring 11 and stops moving upwards through the interference of the holding rib 23.

In addition, the lower case 10 and the upper case 20 can be fixedly coupled with each other via a variety of fastening means. Preferably, a coupling mechanism, such as lock coupling or screw coupling, using a fitting recess and a fitting protrusion can be typically applied.

Sequentially, in the state in which the puff member 40 is coupled with the puff assembly 30, the puff member 40 is moved into the guide section 22 of the upper case 20. Then, the puff member 40 applies downward compressive force to the lift 50 so that the lift 50 moves downwards while pressing the spring 11 that is under the lift 50. The puff assembly 30 can be accommodated inside the seating section 21 of the upper case 20.

Figure 7:
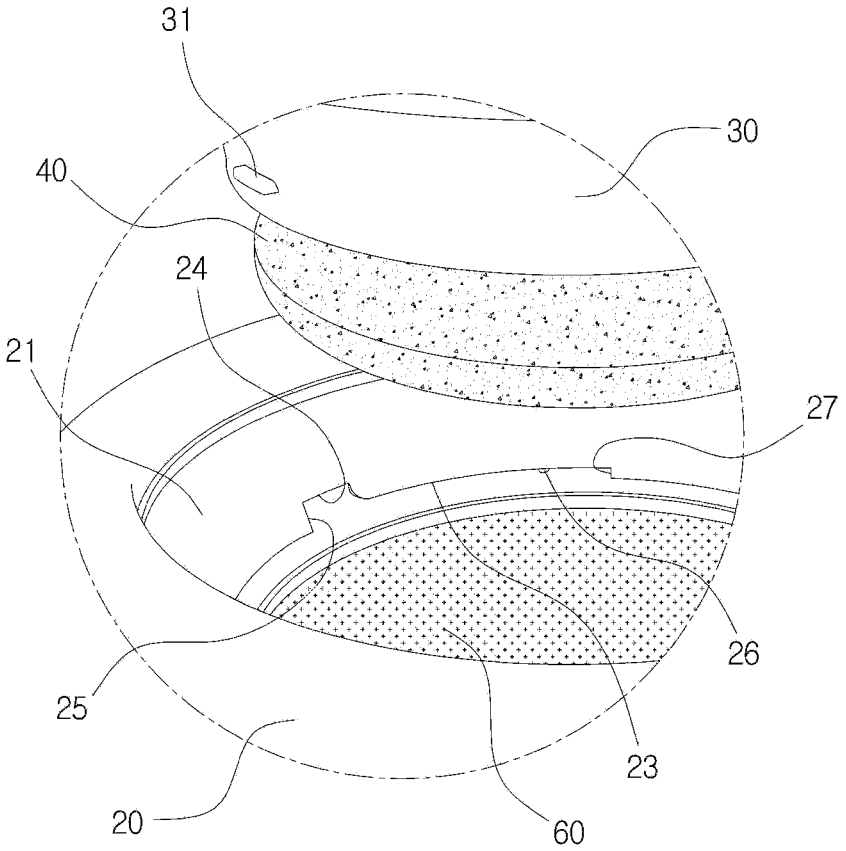
FIG. 7 is an enlarged view showing a fixing section with respect to the puff assembly of the compact according to an exemplary embodiment of the present invention.

The coupling structure between the upper case 20 and the puff assembly 30 will be described with reference to FIG. 7. The plurality of protrusions 31 of the puff assembly 30 are moved downwards through the corresponding fitting holes 24 of the holding rib 23. In this state, the puff assembly 30 is rotated in one direction so that the plurality of protrusions 31 rotates along the bottom surface of the holding rib 23. The plurality of protrusions 31 initially interferes with the interference protrusion 26 formed on the bottom surface of the holding rib 23, thereby giving tactile impression to a user. When the plurality of protrusions 31 arrives at the stepped stop 27 past the interference protrusion 26, the plurality of protrusions 31 stops rotating and is positioned between the interference protrusion 26 and the stepped stop 27, so that a relatively firm coupled and fixed state among them is maintained. Upon arriving at the stepped stop 27 past the interference protrusion 26, the puff assembly 30 stops rotating, and the plurality of protrusions 31 is positioned between the interference protrusion 26 and the stepped stop 27, so that a relatively firm coupled and fixed state among them is maintained.

When artificial force that has been pressing the puff assembly 30 downward is removed, the puff assembly 30 tends to move upwards due to the repulsive force of the spring 11 that has been compressed. Since the plurality of protrusions 31 of the puff assembly 30 is restrained by the interference protrusion 26 and the stepped stop 27 while closely adjoining to the bottom surface of the holding rib 23, the puff assembly 30 cannot spontaneously move in the reverse direction until artificial force is applied to the puff assembly 30.

In addition, in the process of fixing the puff assembly 30 to the upper case 20, when the plurality of protrusions 31 of the puff assembly 30 is fitted into the fitting holes 24 of the holding rib 23, the puff assembly 30 cannot rotate in one direction since it interferes with the anti-rotation rib 25 but can rotate in the other direction. This guides the puff assembly 30 to rotate only in one direction, so that the plurality of protrusions 31 can be locked and seated between the interference protrusion 26 formed on the bottom surface of the holding rib 23 and the stepped stop 27. In contrast, when the puff assembly 30 is rotated in the reverse direction in order to separate it from the upper case 20, the plurality of protrusions 31 interferes with the anti-rotation rib 25 while rotating. Then, the position aligned with the fitting holes 24 is obtained naturally, thereby making the puff assembly 30 be used more conveniently.

This can prevent the puff assembly 30 from rotating accidently and being separated from the upper case 20, prevent the puff assembly 30, accidently separated from the upper case, from causing the cosmetic powder in the puff member 40 to foul the inside of a storage case or a bag, and reduce the risk of the loss of the puff assembly 30.

Therefore, when the puff assembly 30 is pressed downwards and fixed inside the seating section 21 of the upper case 20, the inner dish 60 and the lift 50 which interfere with the puff member 40 of the puff assembly 30 stay at the moved-down position while compressing the spring 11. In this state, when the user rotates the puff assembly 30 in the reverse direction while pressing it downwards, the puff assembly 30 rotates. When the plurality of protrusions 31 of the puff assembly 30 is aligned with the fitting holes of the holding rib 23, the puff assembly 30 can move upwards under the repulsive force of the spring 11.

Figure 8:
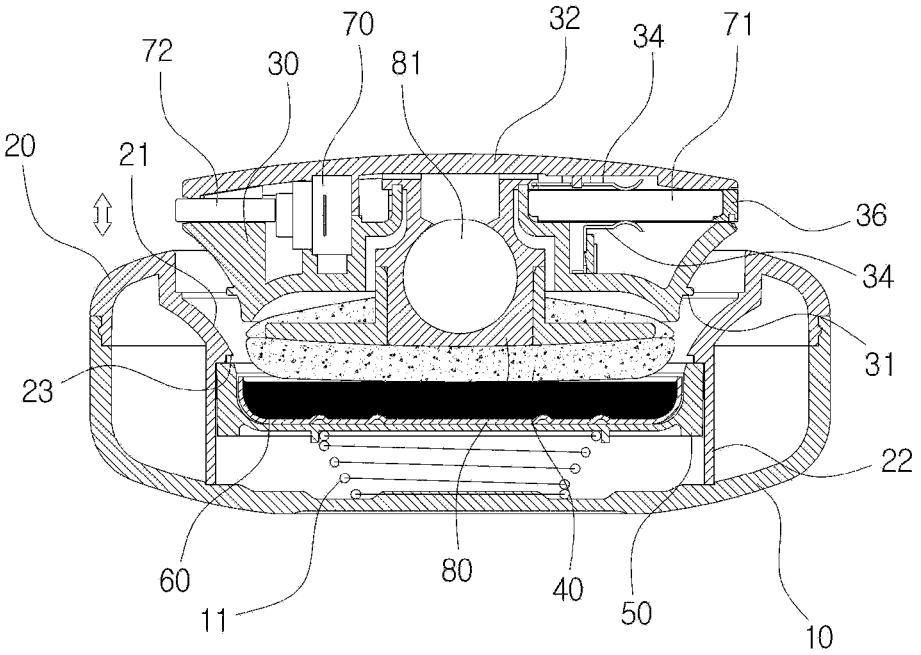
FIG. 8 is a cross-sectional view showing the puff assembly that is protruded from the compact according to an exemplary embodiment of the present invention.

Then, the puff assembly 30 responsively moves upwards from the top surface of the upper case 20, as shown in FIG. 8. The outer surface of the puff assembly 30 that protrudes upward is held with fingers and taken out of the upper case 20 for use.

In this case, since the puff member 40 positioned on the bottom portion of the puff assembly 30 closely adjoins to the upper surface of the upper dish 60, i.e. is in contact with the cosmetic powder inside the inner dish 60, the cosmetic powder inside the inner dish 60 is naturally transferred to the bottom surface of the puff member 40 during the rotation of the puff assembly 30.

The cosmetic powder is naturally transferred to the puff member 40 during the rotation of the puff assembly 30. In addition, when the user holds the puff assembly 30 that is protruded and presses the operation button 72 which is exposed at one side of the puff assembly 30 so that the switch 70 transfers power from the battery 71 to the vibrator 81 inside the elastic moving body 80. Then, the vibrating force of the vibrator 81 is transferred to the puff member 40 through the elastic moving body 80. Accordingly, the user can more rapidly and easily apply makeup and the cosmetic powder is uniformly applied and tightly adheres to the skin.

When the use of the puff assembly is completed, the operation of the vibrator 81 is stopped by pressing the operation button 72 which is externally positioned on the puff assembly 30. In this state, the puff assembly 30 is fitted into and fixed inside the seating section 21 of the upper case 20. In this process, the puff assembly 30 is compressed downward and rotated. During this rotating and fastening process, the puff assembly 30 rubs against and interferes with the cosmetic powder inside the inner dish 60 once more, so that the puff member 40 is ready for rapid and convenient application of makeup.

Moreover, since the puff member 40 is separable from the puff assembly 30, when the puff member 40 is heavily fouled or is to be replaced with a new material or shape of puff member, the coupling member 41 to which the puff member 40 can be coupled is separated from the bottom surface of the puff assembly 30, and a new puff member can substitute for the old one.

The coupling member 41 has the flange 42 which is formed on the lower portion so as to extend radially outward, and is coupled with the puff member 40 in such a shape that the flange 42 surrounds the puff member 40 that is made of a foam, such as sponge. The coupling member 41 is coupled with the moving body 80 by being fitted around the bottom end of the moving body 80. The coupling member 41 and the moving body 80 are assembled together as the bottom end of the elastic moving body 80 is interference-fitted into the leading end of the coupling member 41. Accordingly, it is possible to couple and separate the coupling member 41 having the puff member 40 to and from the elastic moving body 80 by manually applying force thereto.

Accordingly, the compact according to the present invention has overcome the conventional compact case which has the existing hinge-coupled structure and is opened through rotation. In the compact according to the present invention, the assembly 30 is configured to be rotated and separated through pressing and to protrude from the top central portion of the upper case 20. This can attract the interest of consumers. In addition, a portion of the cosmetic powder is naturally transferred to the puff member 40 during the rotation of the puff assembly 30 such that the user can more quickly and conveniently apply makeup.

In particular, when the upper case 20 and the puff assembly 30 are configured such that the upper surfaces thereof are flush or harmonious in the state where the puff assembly 30 is fixedly coupled to the upper case 20, the upper case 20 and the puff assembly 30 can be perceived as an integral part. When the puff assembly 30 is pressed and rotated in this state, the puff assembly 30 protrudes from the upper case 20, so that the user can easily hold the puff assembly 30 and conveniently apply makeup.

Accordingly, the compact according to the present invention proposes a new vessel shape distinctive from the conventional compacts, and reasonably overcomes the several problems of the conventional compacts. Since neither the hinge coupling part nor the locking means for the case is required, a very simple exterior can be produced. Since a smooth outer surface can be formed, it is possible to prevent articles, which are contained together with the case inside a storage case or bag, or clothes from being damaged by the sharp protrusion on the conventional compacts.

The foregoing embodiments discussed in the description and the elements illustrated in the drawings are merely most preferable embodiments of the present invention and do not represent all of the features of the present invention. It should be understood that a variety of equivalents and modifications that can substitute those embodiments and elements are possible.

What is claimed is:

1. A compact having a protrusible and retractable puff, comprising:

a lower case having a spring seated therein;

an upper case having a seating section and a guide section which extend downward through a central portion;

a puff assembly fitted into the seating section, the puff assembly having a puff member fixed to a lower portion;

a lift fitted into the guide section; and an inner dish positioned on top of the lift, wherein the puff assembly has a switch and a battery which are disposed therein, the puff member is coupled to a separate elastic moving body which is coupled to the puff assembly, a vibrator is accommodated inside the elastic moving body, the vibrator operating using power supplied from the battery, and wherein the puff assembly is to be coupled to and separated from the upper case, protrudes upward from the upper case under repulsive force of the spring, and is configured such that the puff member vibrates when the vibrator is operated by the switch and using the power from the battery, wherein a separate cover is coupled to an upper portion of the puff assembly, an assembly hole extends in a top-bottom direction in a central portion of the puff assembly, and the elastic moving body has a vibrator recess extending inward from an upper portion and a fixing flange formed at a leading end, and wherein the fixing flange at the leading end is exposed by extending upward through the assembly hole from a lower portion of the puff assembly in a state in which the vibrator is accommodated in the vibrator recess, and the fixing flange closely adjoins and is fixed to a top surface of the puff assembly and a bottom surface of the cover when the cover is fixed to the puff assembly, whereby the elastic moving body is coupled and fixed to the puff assembly.

2. The compact according to claim 1, wherein a separate cover is coupled to an upper portion of the puff assembly, the switch is disposed between the puff assembly and the cover, and the switch is operated by an operation button which is externally positioned on the puff assembly.

3. The compact according to claim 1, wherein a separate cover is coupled to an upper portion of the puff assembly, and the battery is inserted between the puff assembly and the cover from an outside of the puff assembly, and wherein power terminals are respectively fixed to the puff assembly and the cover, and the battery is seated in a battery holder which is fitted into a battery hole formed in the puff assembly, whereby the battery and the power terminals are grounded when the battery holder is fitted into the battery hole.

4. The compact according to claim 1, wherein a holding rib protrudes inward between the seating section and the guide section, and a protrusion protruding from an outer surface of the puff assembly, wherein the holding rib has a fitting hole into which the protrusion of the puff assembly is fitted, such that the upper case and the puff assembly are fixed to each other as the puff assembly is subjected to the upward repulsive force of the spring when the protrusion of the puff assembly rotates from the upper case while being positioned under the holding rib.

5. The compact according to claim 4, wherein an anti-rotation rib extends downward at one side of the fitting hole, and an interference protrusion and a stepped stop are sequentially formed at the other side of a bottom surface of the fitting hole, such that the protrusion of the puff assembly fitted into the fitting hole is stopped between the interference protrusion and the stepped stop.

6. The compact according to claim 1, wherein a guide groove extends in a top-bottom direction in an inner surface of the guide section, and an insertion protrusion protrudes from an outer surface of the lift so as to be fitted into the guide groove, such that the lift moves upwards in the top-bottom direction without rotation as the insertion protrusion is fitted into the guide groove.

7. The compact according to claim 1, wherein a receiving rib protrudes downward from a bottom surface of the lift, such that a leading end of the spring that adjoins to the bottom surface of the lift is positioned inside the receiving rib.

8. The compact according to claim 1, wherein the puff member is coupled to a flange which is formed on a separate coupling member, and wherein a bottom end of the elastic moving body is interference-fitted into a leading end of the coupling member such that the puff member and the elastic moving body are coupled with each other.

* * * * *